United States Patent [19]

Vrooman et al.

[11] Patent Number: 5,020,750

[45] Date of Patent: Jun. 4, 1991

[54] SYSTEM FOR AUTOMATIC CONSECUTIVE OPENING AND DISPENSING THERMOPLASTIC GROCERY OR RETAIL PRODUCT BAGS

[75] Inventors: Carll D. Vrooman; Harry B. Wilfong, Jr., both of Hartsville, S.C.

[73] Assignee: Sonoco Products Company, Hartsville, S.C.

[21] Appl. No.: 361,130

[22] Filed: Jun. 5, 1989

[51] Int. Cl.[5] ..... B65D 1/34

[52] U.S. Cl. ..... 248/97; 248/99; 53/571; 53/390

[58] Field of Search ..... 248/95-101; 53/571, 390, 384, 385

[56] References Cited

U.S. PATENT DOCUMENTS

| | | | |
|---|---|---|---|
| Re. 33,264 | 7/1990 | Baxley et al. . | |
| 94,283 | 8/1869 | Collins . | |
| 2,899,161 | 8/1959 | Bayard | 248/101 |
| 3,089,633 | 5/1963 | Rensitaw | 206/806 |
| 3,184,055 | 5/1965 | Davis et al. | 206/554 |
| 3,243,937 | 4/1966 | Ragan | 53/384 |
| 3,262,249 | 7/1966 | Finerow | 53/385 |
| 3,317,037 | 5/1967 | Russell | 206/57 |
| 3,380,579 | 4/1968 | Pinto . | |
| 3,439,891 | 4/1969 | Pinto | 248/100 |
| 3,468,100 | 9/1969 | Rubel | 53/189 |
| 3,552,697 | 1/1971 | Pinto | 248/97 |
| 3,640,450 | 2/1972 | Lieberman | 229/53 |
| 3,646,723 | 3/1972 | Meroney | 53/390 |
| 3,747,298 | 3/1973 | Lieberman . | |
| 3,869,065 | 4/1975 | Wang | 221/40 |
| 3,973,376 | 8/1976 | Suominen | 53/385 |
| 4,062,170 | 12/1977 | Orem | 53/390 |
| 4,085,822 | 4/1978 | Osborn | 186/1 A |
| 4,111,297 | 9/1978 | Paulin | 206/806 |
| 4,199,122 | 4/1980 | Christie | 248/97 |
| 4,458,867 | 7/1984 | Malik | 248/97 |
| 4,462,538 | 7/1984 | Gendron | 206/806 |
| 4,480,750 | 11/1984 | Dancy | 206/554 |
| 4,487,388 | 12/1984 | Provan | 248/97 |
| 4,493,419 | 1/1985 | Prader et al. | 206/554 |
| 4,529,090 | 7/1985 | Pilon | 206/554 |
| 4,583,349 | 4/1986 | Kramming | 53/459 |
| 4,676,378 | 6/1987 | Baxley et al. | 206/554 |
| 4,694,503 | 9/1987 | Hydorn | 248/99 X |
| 4,819,898 | 4/1989 | Benoit et al. | 248/97 |
| 4,821,985 | 4/1989 | DeMatteis et al. | 248/97 |

FOREIGN PATENT DOCUMENTS

| | | | |
|---|---|---|---|
| 7946582 | 1/1982 | Australia . | |
| 2803961 | 1/1978 | Fed. Rep. of Germany . | |
| 1486210 | 5/1967 | France | 206/806 |
| 2177996 | 2/1987 | United Kingdom | 248/97 |

*Primary Examiner*—Alvin C. Chin-Shue

*Attorney, Agent, or Firm*—Bell, Seltzer, Park & Gibson

[57] ABSTRACT

A system is provided for automatic consecutive opening and dispensing thermoplastic grocery or retail product bags of the T-shirt type while providing for supporting consecutive bags in an open position and for facilitating easy removel of the consecutive loaded bags. The system includes a pack of bags and a rack of the type having outwardly extending support arms and a retaining means for receiving the bag pack by mounting the bag handles on the support arms of the rack through apertures therein and mounting a detachable bag mounting tab on the rack retaining means. Each of the bags has disengageable adhesive each bag which has a predetermined severance strength greater than the severance strength of the mounting tabs. The rack support arms define a predetermined resistive force in laterally-extending outer portions against sliding of the bags therealong which is greater than the severance strength of the adhesive. Upon removal of each loaded bag from the rack, (1) the adhesive will detach between the rear wall of the loaded bag in the front wall of the next consecutive bag since the resistive force against sliding of the bags along the outer portions of the support arms is greater than the severance strength of the adhesive between the bags and (2) the adhesive before detaching will pull the next consecutive bag from the bag pack into an open loading position on the support arms be severing the mounting tab on the front wall portion of the next consecutive bag since the severance strength of the adhesive is greater than the severance strength of the mounting tabs.

16 Claims, 3 Drawing Sheets

SYSTEM FOR AUTOMATIC CONSECUTIVE OPENING AND DISPENSING THERMOPLASTIC GROCERY OR RETAIL PRODUCT BAGS

FIELD OF THE INVENTION

This invention relates to a system for automatic consecutive opening and dispensing thermoplastic grocery or retail product bags of the T-shirt type while providing for supporting consecutive bags in an open position and for facilitating easy removal of the consecutive loaded bags.

BACKGROUND OF THE INVENTION

Since the 1970s plastic bags have been replacing paper bags in the United States for the grocery and retail products industries due to the superior and inherent moisture resistant properties of plastic. For these industries, these plastic bags have been for the most part of the T-shirt type which provide laterally spaced handles integrally extending upwardly from opposed sides of an open mouth portion in the top of the bag to provide ease in carrying of the bag by the consumer. These T-shirt bags have generally been provided to and used by the grocery and retail product industries in the form of packs of a plurality of such bags secured together and mounted on a rack for consecutive detachment of the bags from the pack and for holding the bag in an open position for loading before removal from the rack.

The major problems encountered with these plastic T-shirt bag pack and rack systems has been the development of such a system that will adequately and efficiently provide a means for dispensing and loading bags made of ultra-thin plastic material that in many cases are very difficult and cumbersome to work with because of their flexible nature. These problems are compounded in cases where the person filling the bag with grocery or retail products is not trained or familiar with the particular bag/rack system, as is the case in many supermarkets and other stores where the turnover rate of employees is high or where the customer is required to bag his own items. This was particularly true where the bag/rack system required removal of consecutive bags from a pack mounted on a rack by a central mounting tab and stretching the handles of the removed bag over tabs on arm portions of a rack, such as disclosed in U.S. Pat. No. 4,487,388 assigned to Mobil Oil Corporation.

A major break through with this problem came with the development of the QUIKMATE® bag/rack system which mounted a pack of thermoplastic grocery bags of the T-shirt type on a rack by a central mounting tab and by apertures in the handles of the bags, for supporting consecutive bags from the pack on supporting rods or arms on the rack in an open loading position by apertures in the handles on the supporting rods and for facilitating each removal of the consecutive loaded bags from the rack, as disclosed in U.S. Pat. No. 4,676,378 assigned to Sonoco Products Company (the assignee of the present application). This QUIKMATE® bag/rack system allowed consecutive bags to be opened by a single motion of the hand to break the central mounting tab on the front wall portion of the bag and pull the front wall portion of the bag open by sliding the bag handles having apertures therein along the outwardly extending support rods of the rack for loading of the bags. This QUIKMATE® system has been very successful in most applications once the person using the bag has practiced using the QUIKMATE® bag/rack system. This system has replaced most of the prior bag/rack systems in the grocery and retail products industries. However, there are still certain problems with the manual opening of consecutive bags with the QUIKMATE® bag/rack system where the user of the system does not break only the front side of each consecutive bag from the mounting tabs to properly position the bag in open loading position on the rack.

OBJECT AND SUMMARY OF THE INVENTION

Accordingly, it is the object of this invention to overcome the above discussed problems and to provide a system for automatic consecutive opening and dispensing of thermoplastic grocery or retail product bags of the T-shirt type while providing for supporting consecutive bags in an open position and for facilitating easy removal of the consecutive loaded bags.

It has been found by this invention that the above object may be accomplished by providing such a system including a bag pack and a rack including generally the following features.

The bag pack is formed of a plurality of stacked T-shirt type bags secured together. Each of the bags has front and rear wall portions integrally connected at sides thereof and secured together at the bottom thereof and defining an open top mouth portion. Laterally spaced handles are integrally formed with the wall portions and extend upwardly from opposed sides of the mouth portion and include a support arm receiving aperture formed through an intermediate portion of each of the handles. A detachable mounting tab extends upwardly from each of the front and rear wall portions at a central area of the mouth portion. Each of the mounting tabs includes a mounting aperture or slot therein and means detachably connecting the mounting tab to the respective wall portion which defines a predetermined severance strength for detachment from the respective wall portion. Disengageable adhesive means connect each of the rear wall portion to each of the front wall portion, preferably below the mouth portion, of each consecutive bag in the bag pack and has a predetermined severance strength greater than the severance strength of the mounting tab connecting means.

The rack for mounting the bag pack includes a generally horizontally extending bag supporting base means. Two generally horizontally and outwardly extending support rods or arms are provided on the rack and are laterally spaced from each other and vertically spaced from the base portion and have linearly-extending free outer end portions (1) for slidably receiving the apertures in the bag handles and mounting the bag pack, (2) for supporting consecutive ones of the bags in an open loading position on the base means as the bags are consecutively removed from the pack and slid along the support arms and (3) for facilitating removal of consecutive loaded bags by sliding the handles off the support arms at the linearly-extending free outer end portions The support arms include means for providing a resistive force against sliding of the bags therealong in the outer portions thereof which is greater than the severance strength of the disengageable adhesive means. The rack further includes bag mounting tab retaining means positioned generally between the support arms and extending outwardly a distance less than the extension of the support arms (1) for receiving the mounting apertures in the mounting tabs of the bags, (2) for cooperating with the support arms to mount the bag pack on the rack and (3) for allowing consecutive detachment of the front and rear wall portions of each of the bags from the mounting tabs as the bags are slid outwardly along the support arms into the open loading position by retaining the mounting tabs on the retaining means.

With the above bag pack and rack system of this invention and upon removal of each loaded bag from the rack, (1) the adhesive means will detach between the rear wall portion of the loaded bag and the front wall portion of the next consecutive bag since the resistive force against sliding of the bags along the linearly-extending outer portions of the support arms is greater than the severance strength of the adhesive means and (2) the adhesive means before detaching will pull the next consecutive bag from the bag pack into open loading position on the support arms by severing the mounting tab on the front wall portion of the next consecutive bag since the severance strength of the adhesive means is greater than the severance strength of the mounting tabs.

The support arms may be of different constructions for providing the resistive force against sliding of the bags therealong in the outer free end portions Such support arms may preferably comprise a cylindrical metal rod forming a rear portion and a linearly-extending cylindrical plastic rod of generally the same diameter as the metal rod and forming the outer free end portions wherein the plastic rod provides the resistive force against sliding of the bags therealong in the outer free end portions Alternatively, the support arms may preferably comprise a rear portion extending at a predetermined angle with respect to a longitudinal axis and a forward portion forming the outer free end portions and extending at a predetermined angle with respect to the longitudinal axis which is smaller than the predetermined angle of the rear portion for providing a resistive force against sliding of said bags therealong in said outer end portions.

The bag supporting base of the rack may comprise a stationary base member for manually sliding the loaded bag forward thereon to remove the loaded bag from the rack and to open the next consecutive bag, or may comprise a driven conveyor means for automatically moving the loaded bag forwardly off of the rack and for opening the next consecutive bag.

BRIEF DESCRIPTION OF THE DRAWINGS

Some of the objects and advantages of the invention have been set forth above and other objects and advantages of the invention will become apparent in the detailed description of preferred embodiments of the invention to follow, when taken in conjunction with the accompanying drawings in which.

DETAILED DESCRIPTION OF PREFERRED EMBODIMENTS OF THE INVENTION

Figures 1, 2, 3:
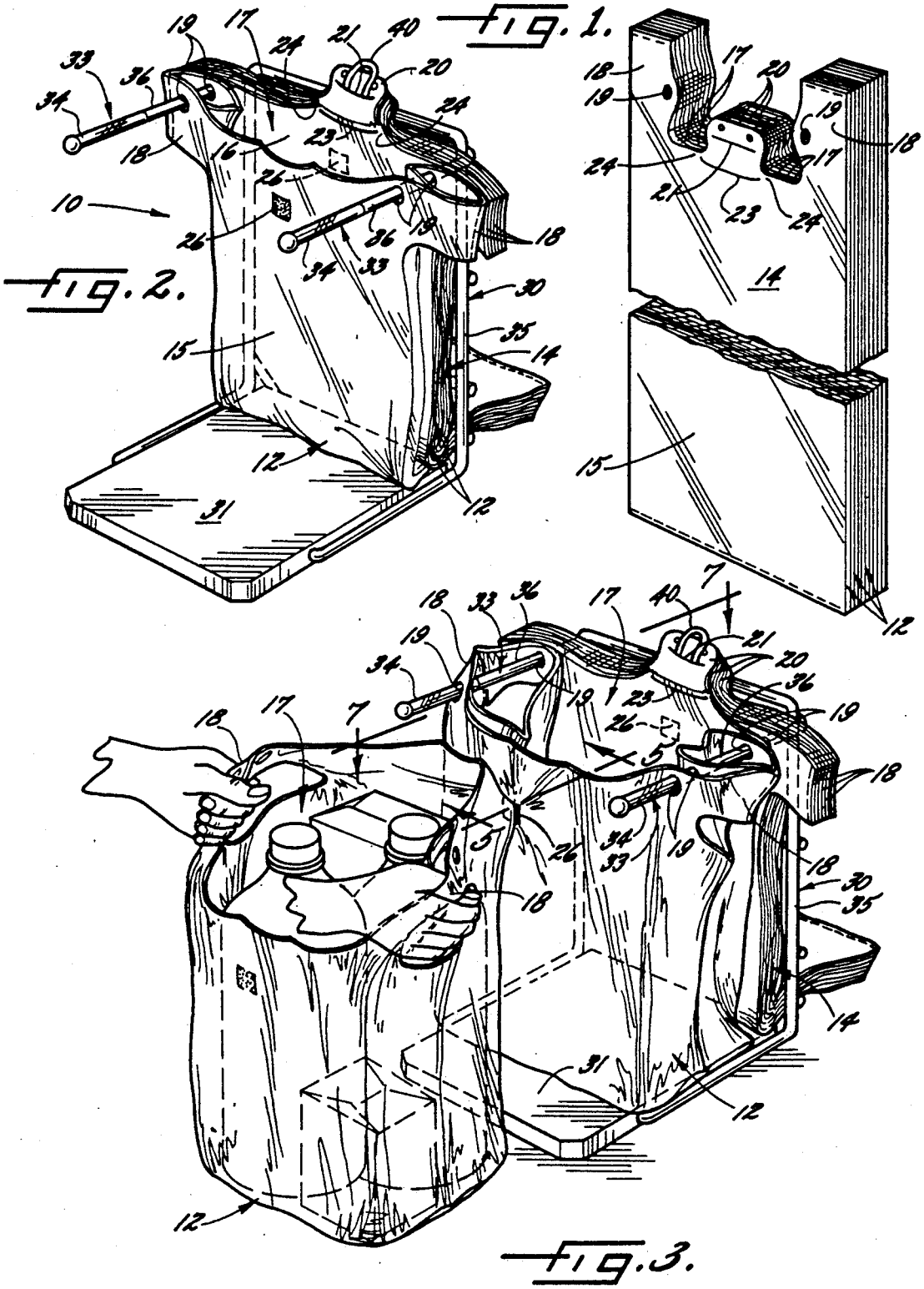
FIG. 1 is a perspective view, broken away, of a bag pack utilized in the system of this invention.
FIG. 2 is a perspective view of a first embodiment of a bag pack and rack system of this invention.
FIG. 3 is a perspective view of the bag pack and rack system of FIG. 2 illustrating the removal of a loaded bag and the opening of the next consecutive bag during use of the system.

Referring now to the drawings, two embodiments of a system, generally indicated at 10, 10', for automatic consecutive opening and dispensing of thermoplastic grocery or retail product bags 12 are illustrated in FIGS. 2–8 and 9–11, respectively. It is to be understood, as will be explained in more detail hereinafter, that some of the features from each of these embodiments may be used in the other of the embodiments. Additionally, other embodiments of a system may be utilized which incorporate the novel features of this invention.

Referring now to FIG. 1, there is shown therein a pack 14 of a plurality of stacked T-shirt type bags secured together Each of the bags 12 may be formed from any suitable material including high density polyethylene film. As shown in FIG. 1 and also in FIGS. 2–5 and 7, each of the bags 12 comprise front and rear wall portions 15, 16 integrally connected at sides thereof and secured together at the bottom thereof and defining an open top mouth portion 17. Laterally spaced handles 18 are integral with the wall portions 15, 16 and extend upwardly from opposed sides of the mouth portion 17 and include a support arm receiving aperture 19 through an intermediate portion of each of the handles 18. The apertures 19 are preferably formed through an inwardly extending non-detachable tab portion on the inside of the handles, as shown in FIG. 1, for strength purposes. The bags 12 may also include inwardly folded side gusset portions as are conventional with such T-shirt bags to in effect form a four film layer handle portion for strength in the handles.

A detachable mounting tab 20 extends upwardly from each of the front and rear wall portions 15, 16 at a central area of the mouth portion 17. Each of the mounting tabs includes a mounting slot or aperture 21 therein and means detachable connecting the mounting tab 20 to the respective wall portion 15, 16 and defining a predetermined severance strength for detachment from the respective wall portion 15, 16. This means may comprise a line of severance or cut 23 extending along the base of the mounting tab 20 and leaving a residual 24 of thermoplastic film on each side thereof which defines the predetermined severance strength for detachment from the respective wall portion 15, 16. The attachment width of these residuals 24 must be determined based upon the thickness and tear strength characteristics of the particular thermoplastic film material being used in forming the bags 12. It has been found preferable to have a severance strength for detachment of the mounting tab 20 from the respective wall portion 19, 20 of approximately 0.1 to 1.0 lbs. A preferred but non-limiting example is a residual width of approximately 0.1 inch per side for high density polyethylene film at a thickness of approximately 0.7 mil to provide the preferred severance strength of approximately 0.3 lbs. for each residual on each side of the line of severance or a total severance strength of 0.6 lbs. This severance strength of the mounting tab 20 should not be too small since this would cause premature breakage of the rear panel 16 of the bag 12 from its mounting tab 20 and hinder proper operation of the system of this invention and supporting of the bag 12 in the open loading configuration, as will be discussed in more detail below.

Disengageable adhesive means 26 connects each rear wall portion 16 to each front wall portion 15, preferably below the bag mouth 17, of each consecutive bag 12 in the bag pack 14. This disengageable adhesive means has a predetermined severance strength greater than the severance strength of the mounting tab connecting means or residuals 24. For the above discussed preferred severance strength of the detachable mounting tabs 20, it has been found that a preferred severance strength of the adhesive means 26 should comprise from about 0.3 to 4.0 lbs. The adhesive means 26 may comprise one or more areas of adhesive or glue, preferably a pressure sensitive hot melt such as commercially available Himont's Afax 600 Amorphous Polypropylene or the like, to form a releasable bond. The adhesive spots are preferably of comparable thickness to the gage of the thermoplastic film utilized in manufacture of the bags 12 so as not to cause a dramatic increase in the height of the bag pack 14 in the areas of the adhesive spots. The adhesive is further defined as having a shear strength greater than its peel strength, preferably in a ratio of about 10 to 1 so as to allow for maximum benefit during severance of the mounting tab 20 at the final stages of loading and removal of the loaded bag and minimum peel affect during the stages when the bags are being opened, as to be discussed in more detail below. A specific but non-limiting example is an adhesive applied in an area of approximately 9/16 inch in diameter at an approximate thickness of 1 mil with a peel strength of approximately 0.23 lbs. and a shear strength of approximately 2.5 lbs.

The above described bag pack 14 and construction of bags 12 may be utilized in both of the embodiments of the system 10, 10' of this invention and like reference characters have been utilized for the pack 14 and bags 12 throughout all figures of the drawings.

Figure 4:
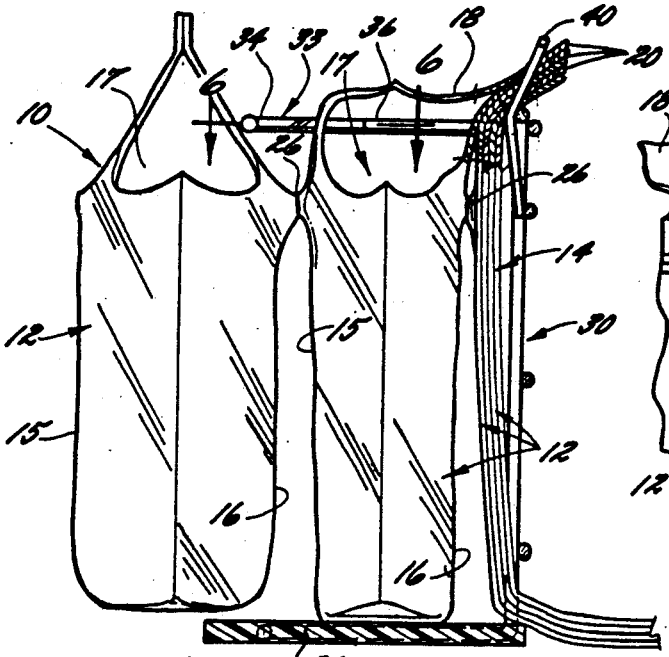
FIG. 4 is a side elevational view, partly in section, generally like FIG. 3.
Figure 5:
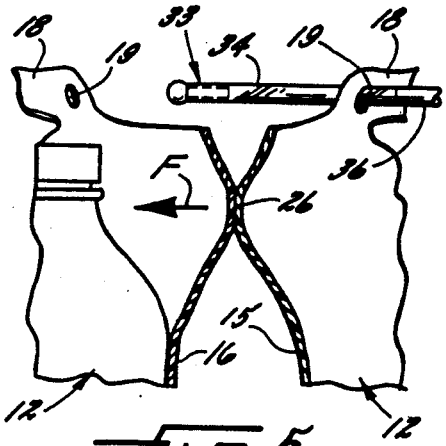
FIG. 5 is an enlarged section detail showing the detachable adhesive means connecting consecutive bags and utilized for opening of the next bag when a loaded bag is removed from the rack.

The first embodiment of the system 10 of this invention further includes a rack 30 for mounting the bag pack 14 and for consecutive dispensing of the bags 12. The rack 30 comprises a generally horizontally extending bag supporting base 31 and two generally horizontally and outwardly extending support arms 33 laterally spaced from each other and vertically spaced from the base 31 and having laterally-extending free outer end portions 34. These support arms 33 may be suitably mounted on a vertically extending frame portion 35 which is secured to the base 31 and extends vertically upwardly therefrom for mounting the support arms 33 in the above described desired position. The support arms 33 slidably receive the apertures 19 in the bag handles 18 and mount the bag pack 14 on the rack 30. The support arms 33 further support consecutive ones of the bags 12 in an open loading position on the base 31 as the bags are consecutively removed from the pack 14 and slid along the support arms 33. The support arms 33 further facilitate removal of consecutive loaded bags by sliding the handles 18 of the bags 12 off the support arms 33 at the laterally-extending free outer end portions 34, as shown in FIGS. 3 and 4.

Each of the support arms 33 includes means for providing a resistive force against sliding of bags therealong in the laterally-extending outer portions 34 which is greater than the severance strength of the disengageable adhesive means 26. This resistive force against sliding of the bags 12 in the outer portions 34 of the support arms 33 of the rack 30 may preferably comprise from about 1.0 to 5.0 lbs. with the above described preferred severance strength of the adhesive means and severance strength of the mounting tabs.

Figure 6:
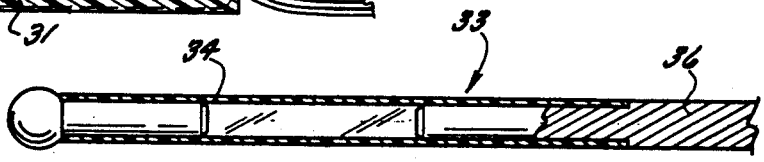
FIG. 6 is a sectional view, taken generally along the lines 6—6, through one of the rack support arms.
Figure 7:
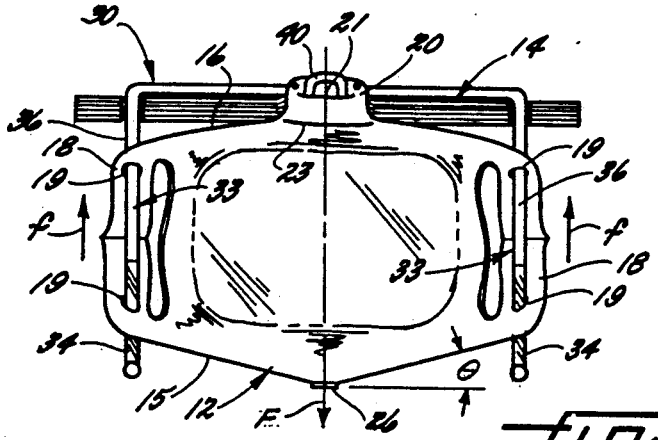
FIG. 7 is a top plan view of the bag and rack system of FIG. 2 with a bag in open loading position and showing certain force relationships and angles utilized in the automatic opening of bags with the system of this invention.
Figure 8:
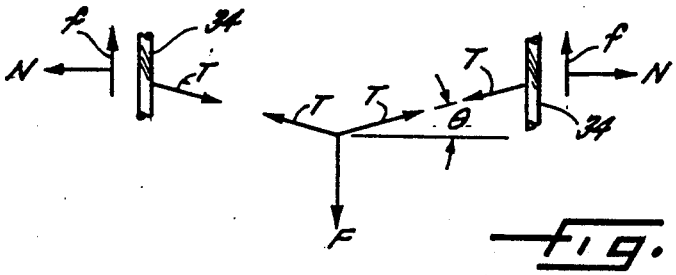
FIG. 8 is a free body force diagram corresponding to FIG. 7.

In the first embodiment of the system 10 of FIGS. 2–8, the support arms 33 comprise a cylindrical metal rod forming a rear portion 36 and a laterally-extending cylindrical plastic rod of generally the same diameter as the metal rod and forming the free outer end portions 34. The laterally-extending plastic rod 34 provides a resistive force against sliding of the bags therealong in the outer free end portions and also provides a flexible outer end portion for ease in removal of a loaded bag 12 from the rack 30. The metal rod portion 36 may be chrome-plated steel approximately 0.33 inch in diameter with a one inch section at the end where the diameter has been turned down to approximately 0.265 inch for receiving the plastic rod portion 34 which may be in the form of a tube. A plug may be inserted into the outer end of the plastic tube 34, as shown in FIG. 6. The metal rod portion 36 and plastic rod portion 34 form a smooth transition so that the bag handles 18 may slide freely from the metal rod portion 36 onto the plastic rod portion 34 and will not be caught at this transition point and potentially tear or hamper removal of the bag 12 from the rack 30. The plastic rod may be made from any suitable piece of plastic tubing or rubber with an approximately 5/16 inch OD and ¼ inch ID and 4 inches long. A preferred material is Norton Corporation's Tygothane tubing type or the like with a coefficient of friction of about 0.9 which is about 4 times that of the metal rod portion 36. The friction force or resistive force against sliding is an important variable in the system 10 of this invention, as will be discussed in more detail below.

The rack 30 further includes bag mounting tab retaining means 40 positioned generally between the support arms 33 and extending outwardly a distance less than the extension of the support arms 33. This retaining means may be of any suitable shape including a generally upturned U-shaped hook configuration, as shown in FIGS. 2–4. The bag mounting tab retaining means 40 performs (1) for receiving the mounting apertures 21 in the mounting tabs 20 of the bags 12, (2) for cooperating with the support arms 33 to mount the bag pack 14 on the rack 30 and (3) for allowing consecutive detachment of the front and rear wall portions 15, 16 of each of the bags 12 from the mounting tabs 20 as the bags 12 are slid outwardly along the support arms 33 into open loading position by retaining the mounting tabs 20 on the retaining means 40.

With the above construction, as may be seen particularly in FIGS. 2, 3 and 4, and upon removal of each loaded bag 12 from the rack 30, (1) the adhesive means 26 between bags 12 will detach between the rear wall portion 16 of the loaded bag and the front wall portion 15 of the next consecutive bag 12 since the resistive force against sliding of the bags along the laterally-extending outer portions of the support arms 33 is greater than the severance strength of the adhesive means 26 and (2) the adhesive means before detaching will pull the next consecutive bag 12 from the bag pack 14 into open loading position on the support arms 33 by severing the mounting tab 20 on the front wall portion 15 of the next consecutive bag 12 since the severance strength of the adhesive means 26 is greater than the severance strength of the mounting tabs 20. Accordingly, the severance strength of the adhesive means 26 must be greater than the severance strength of the bag mounting tabs 20 and must be less than the resistive force provided by the outer end portions 34 of the support arms 33 against sliding of the bags along the support arms 33 so as to provide automatic separation of the loaded bag 12 from the remaining bags 12 in the pack 14 and opening of the next consecutive bag in the pack 14 along the support arms 33 of the rack 30.

In accordance with this invention, these specific strengths and forces may be determined in accordance with certain relationships, as follows. The resistive or friction force f against sliding of the bags 12 in the outer portions 34 of the support arms 33 of the rack 30 is proportional to the coefficient of friction u of the outer portions 34 of the support arms 33 and the normal force N between the bags 12 and the support arms 33. This is defined by Coulomb's Law of $$\zeta = u\,N$$

wherein $\zeta$ is friction or resistive force, u is coefficient of friction and n is the normal force. The normal force N between the bags 12 and the support arms 33 is determined by the geometric relationship between the adhesive means 26 on the front wall of the bag 12 being pulled into open position and the apertures 19 in the bag handles 18 being slid along the support arms 33 and is defined by the equation of $$N = T \cos \Theta$$

wherein N is the normal force, T is the tension force of the bag on the support arms and $\Theta$ is the angle between the tension force T and support arms 33. The tension force T of the bag 12 on the support arms 33 is a function of the angle $\theta$ between the tension force T and the support arms 33 and is defined by the equation of $$T = F/2 \sin \Theta$$

wherein T is the tension force, F is the force exerted by the adhesive means 26 before detaching and pulling the next consecutive bag into open loading position and $\Theta$ is the angle between the tension force T and the support arms 33.

Thus, as may be seen from the above equations, as the angle $\Theta$ increases, the tension force T decreases. Also, it can be appreciated that if the support arms 33 were simply a straight metal rod, the friction force or resistive force of the bag on the arm would be essentially constant and the adhesive means 26 would not disengage and would cause a continuous chain of bags rather than a severance in the adhesive as desired. In using the above equations, it should be assumed that the weight of the loaded bag is being supported by the rack base 31. However, if the weight of the bag is not supported or if the angle of removal of the loaded bag 12 from the rack 30 is not parallel to the rack base, this would cause magnification of the normal force N and the friction or resistive force f of the rack arms. It has also been observed that a condition of dynamic friction (slippage) is quickly achieved when the bag 12 is moving over the metal rod portion 36 of the support arms 33; however, once the bag reaches the plastic rod portion 34 of the support arms 33, a marked increase in force is obtained. In fact with some materials, the coefficient of friction was sufficient to stop slippage and the force would continue to increase until it again reached a level sufficient to induce slippage.

Figure 9:
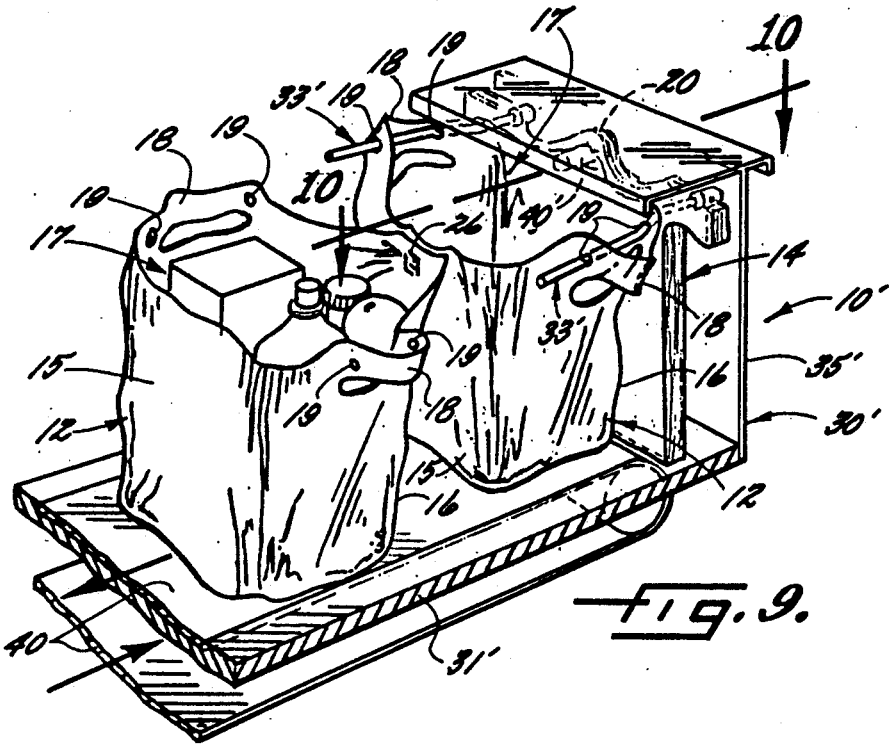
FIG. 9 is a perspective view, like FIG. 3, of a second embodiment of the invention.
Figure 10:
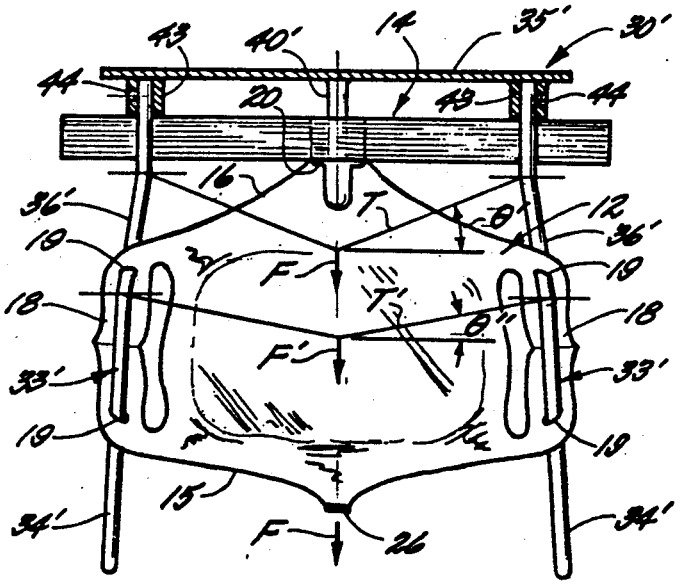
FIG. 10 is a view, like FIG. 7, of the second embodiment of the invention of FIG. 9.
Figure 11:
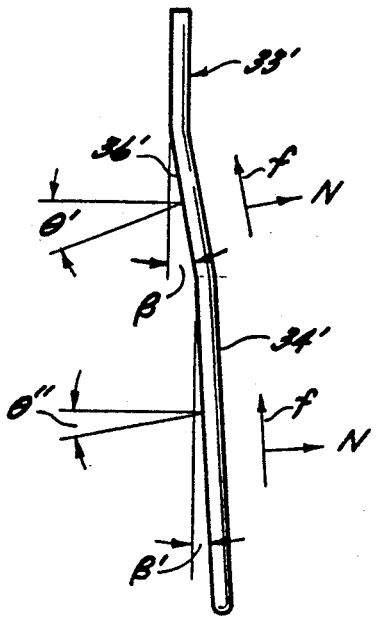
FIG. 11 is a free body force diagrams, like FIG. 8, and relating to the second embodiment of this invention of FIG. 9.

Referring now to the second embodiment of the bag/rack system 10' of this invention, as illustrated in FIGS. 9–11, like references characters with prime notations have been given to elements of the rack 30' which are substantially the same as such elements in the first embodiment of the bag/rack system 10 of FIGS. 2–8.

In this second embodiment of a system 10', the horizontally extending bag supporting base means 31' comprises a driven endless conveyor device 40 for being actuated to automatically move the loaded bag forwardly off of the rack 30' and for opening the successive bag 12, as shown in FIG. 9.

Additionally, the support arms 33' comprise a rear portion 36' which extends at a predetermined angle $\beta$ with respect to a longitudinal axis, and a forward portion 34' forming the outer free end portions and extending at a predetermined angle $\beta'$ with respect to the longitudinal axis which is smaller than the predetermined angle $\beta$ of the rear portion 36' for providing a resistive force against sliding of the bags therealong in the outer end portions 34' which is greater than the severance strength of the disengageable adhesive means 26, for the reasons discussed above. Thus, the resistive force f of the outer end portions 34' of the support arms 33' of this second embodiment of a system 10' is achieved by a bend in the rack support arms 33' rather than by using different materials with different friction characteristics, as was the case in the first embodiment of the system 10. The resistive force f against sliding of the bags 12 along the support arms 33' is created purely from the geometric relationship of the adhesive means 26 of the bags 12 to the rack arms 33' as the bags 12 slid out on the rack support arms 33'. As shown in FIG. 10, the bag not only encounters an increase in tension because of the change in the distance between support arms 33', but the normal force N is also increased by a reduction in the angle $\Theta$ between the rack support arms 33 and the tension force T. It has been found that the angle $\beta$ should be approximately 15° and that the angle $\beta'$, should be approximately 0°.

In this embodiment, the support arms are rotatably mounted in collar portions 43 and may be fixed in desired positions by set screws 44 so that the arms may be rotated to achieve the desired angles for $\beta$ and $\beta'$. The remaining force relationships and equations set forth above along with the values of severance strengths and resistive forces may also apply equally as well to this second embodiment of a bag/rack system 10'.

Thus, there has been disclosed two preferred embodiments of a system 10, 10' for automatic consecutive opening and dispensing thermoplastic grocery or retail product bags 12 of the T-shirt type while providing for supporting consecutive bags 12 in an open position and for facilitating easy removal of the consecutive loaded bags 12. The two embodiments have been described with alternative support arm 33, 33' constructions and base 31, 31' constructions for the racks 30, 30' which receive the bag pack 14. Either of these alternative constructions may be utilized in either of the embodiments of the system 10, 10'.

In the drawings and specification there have been set forth preferred embodiments of this invention, and although specific terms are employed, they are used in a generic and descriptive sense only and not for purposes of limitation, the scope of the invention is defined in the following claims.

What is claimed is:

1. A system for automatic consecutive opening and dispensing thermoplastic grocery or retail product bags of the T-shirt type while providing for supporting consecutive bags in an open position and for facilitating easy removal of the consecutive loaded bags; said system comprising:

a bag pack comprising a plurality of stacked T-shirt type bags secured together, each of said bags comprising front and rear wall portions integrally connected at sides thereof and secured together at the bottom thereof and defining an open top mouth portion, laterally spaced handles integral with said wall portions and extending upwardly from opposed sides of said mouth portion and including a support arm receiving aperture formed through an intermediate portion of each of said handles, a detachable mounting tab extending upwardly from each of said front and rear wall portions at a central area of said mouth portion, each of said mounting tabs including a mounting aperture therein and means detachably connecting said mounting tab to said respective wall portion and defining a predetermined severance strength for detachment from said respective wall portion, and disengageable adhesive means connecting each said rear wall portion to each said front wall portion of each consecutive bag in said bag pack and providing a predetermined adhesive severance strength therebetween; and a rack for mounting said bag pack and consecutive dispensing of said bags, said rack comprising generally horizontally extending bag supporting base means, two generally horizontally and outwardly extending support arm means laterally spaced from each other and vertically spaced from said base means and each having a linearly-extending free outer end portion (1) for slidably receiving said apertures in said bag handles and mounting said bag pack, (2) for supporting consecutive ones of said bags in an open loading position on said base means as said bags are consecutively removed from said pack and slid along said support arms and (3) for facilitating removal of consecutive loaded bags by sliding said handles off said support arms at said linearly-extending free outer end portion, each of said support arm means comprising a cylindrical metal rod forming a rear portion, and a linearly-extending cylindrical plastic rod of generally the same diameter as said metal rod and forming said free outer end portion and providing a predetermined resistive force against sliding of said bags therealong, bag mounting tab retaining means positioned generally between said support arm means and extending outwardly a distance less than the extension of said support arm means (1) for receiving said mounting apertures in said mounting tabs, (2) for cooperating with said support arm means to mount said bag pack on said rack and (3) for allowing consecutive detachment of said front and rear wall portions of each of said bags from said mounting tabs as said bags are slid outwardly along said support arm means into the open loading position;

said predetermined tab severance strength being less than said predetermined adhesive severance strength so that said, detachable mounting tab detaches prior to severance of said adhesive means as said bags are consecutive removed from said pack and slid along said support arm means; and said predetermined adhesive severance strength being less than said predetermined resistive force of said support arm means so that said adhesive means severe as said bags are slid along said support means and are consecutive removed from said rack.

2. A system, as set forth in claim 1, in which said plastic rod has a coefficient of friction of about 4 times the coefficient of friction of said metal rod and which coefficient of friction of said plastic rod is about 0.9.

3. A system, as set forth in claim 1, in which said generally horizontally extending bag supporting base means comprises a stationary base member for manually sliding the loaded bag forwardly thereon to remove the loaded bag from said rack and to open the successive bag.

4. A system, as set forth in claim 1, in which said generally horizontally extending bag supporting base means comprises driven conveyor means for automatically moving the loaded bag forwardly off of said rack and for opening the successive bag.

5. A system, as set forth in claim 1, in which said predetermined tab severance strength of said detachable mounting tabs is about 0.1 to 1.0 lbs.

6. A system, as set forth in claim 1, in which said predetermined adhesive severance strength of said adhesive means is about 0.3 to 4.0 lbs.

7. A system, as set forth in claim 1, in which said predetermined resistive force of said support arm means against sliding of said bags therealong is about 1.0 to 5.0 lbs.

8. A system, as set forth in claim 1, in which said predetermined tab severance strength of said detachable mounting tabs is about 0.1 to 1.0 lbs., said predetermined adhesive severance strength of said adhesive means is about 0.3 to 4.0 lbs., and said predetermined resistive force of said support arm means against sliding of said bags therealong is about 1.0 to 5.0 lbs.

9. A system, as set forth in claim 1, in which said predetermined resistive force of said support arm means against sliding of said bags therealong is proportional to the coefficient of friction of said outer end position of said support arms and the normal force between said bags and said support arms and is defined by Coulomb's Law of $\zeta = u\,N$, wherein $\zeta$ is friction or resistive force, u is coefficient of friction and N is the normal force.

10. A system, as set forth in claim 9 in which the normal force between the bags and the support arms is determined by the geometric relationship between the adhesive means on said front wall portion of said bag being pulled into open position and said apertures in said bag handles being slid along said support arm means and is defined by the equation of $N = T \cos \Theta$, wherein N is the normal force, T is the tension force of said bag on said support arms and $\Theta$ is the angle between the tension force T and said support arm means.

11. A system, as set forth in claim 10, in which the tension force of said bag on said support arms is a function of the angle between the tension force and said support arm means and is defined by the equation of $T = F/2 \sin \Theta$, wherein T is the tension force, F is the force exerted by said adhesive means before detaching in pulling the next consecutive bag into open loading position and $\Theta$ is the angle between the tension force and said support arm means.

12. A system, as set forth in claim 1, in which said detachable mounting tab includes a line of severance extending along the base thereof and leaving a residual on each side thereof defining said means detachably connecting said mounting tab to said front and rear wall portions and defining said predetermined tab severance strength for detachment from said respective wall portion.

13. A system, as set forth in claim 12, in which each of said residuals on each side of said line of severance of said mounting tab comprises a width of approximately 0.1 inch and a thickness of approximately 0.7 mil to provide a severance strength of approximately 0.3 lbs. for each of said residuals.

14. A system, as set forth in claim 1, in which said disengageable adhesive means has a shear strength greater than its peel strength and preferably in a ratio of about 10 to 1 to provide said predetermined adhesive severance strength.

15. A system, as set forth in claim 14, in which said adhesive means comprises a pressure sensitive hot melt polypropylene adhesive.

16. A system, as set forth in claim 15, in which said adhesive means is applied in an area approximately 9/16 inch in diameter at an average thickness of 1 mil.

* * * * *

UNITED STATES PATENT AND TRADEMARK OFFICE

CERTIFICATE OF CORRECTION

PATENT NO. : 5,020,750

DATED : June 4, 1991

INVENTOR(S) : Carll D. Vrooman and Harry B. Wilfong, Jr.

It is certified that error appears in the above-identified patent and that said Letters Patent is hereby corrected as shown below:

IN THE ABSTRACT:

Line 12, after "adhesive" insert -- between; line 26, "be" should be -- by --.

IN THE SPECIFICATION:

Column 3, line 24, after "portions" insert -- . --; line 31, after "portions" insert -- . --.

Column 4, line 8, after "corresponding" insert -- generally --; line 33, after "together" insert -- . --.

Column 9, line 36, delete "defining" and insert therefor -- providing --; after "predetermined" insert -- tab --.

UNITED STATES PATENT AND TRADEMARK OFFICE

CERTIFICATE OF CORRECTION

PATENT NO. : 5,020,750

DATED : June 4, 1991

INVENTOR(S) : Carll D. Vrooman, et al.

It is certified that error appears in the above-identified patent and that said Letters Patent is hereby corrected as shown below:

Column 10, line 15, after "said", delete -- , --; line 17, "consecutive" should be -- consecutively --; line 23, "severe" should be -- severs --; line 24, "consecutive" should be -- consecutively --; line 36, after "1" insert -- or 2 --.

Signed and Sealed this

Twenty-fourth Day of November, 1992

*Attest:*

DOUGLAS B. COMER

*Attesting Officer*

*Acting Commissioner of Patents and Trademarks*